United States Patent [19]

Tompkins et al.

[11] Patent Number: 5,027,158

[45] **Date of Patent: * Jun. 25, 1991**

[54] VERTICAL PRINT ENGINE FOR ELECTROPHOTOGRAPHIC APPARATUS

[75] Inventors: E. Neal Tompkins, Roswell; Danny L. Slayton, Lilburn, both of Ga.

[73] Assignee: Colorocs Corporation, Norcross, Ga.

[ * ] Notice: The portion of the term of this patent subsequent to Feb. 13, 2007 has been disclaimed.

[21] Appl. No.: 403,171

[22] Filed: Sep. 5, 1989

Related U.S. Application Data

[63] Continuation of Ser. No. 135,113, Dec. 18, 1987, Pat. No. 4,901,110.

[51] Int. Cl.[5] ..... G03G 15/16; G03G 15/01

[52] U.S. Cl. ..... 355/271; 355/212; 355/327

[58] Field of Search ..... 355/212, 271, 277, 326, 355/327; 346/160

[56] References Cited

U.S. PATENT DOCUMENTS

| | | | |
|---|---|---|---|
| 3,386,379 | 6/1968 | Gundlach | 430/126 |
| 3,574,456 | 4/1971 | Grace | 355/326 |
| 3,690,756 | 9/1972 | Smith | 355/327 |
| 3,981,578 | 9/1976 | Heinzer | 355/212 |
| 4,009,958 | 3/1977 | Kurita et al. | 355/212 |
| 4,330,194 | 5/1982 | Murakami | 355/271 |
| 4,652,115 | 3/1987 | Palm et al. | 355/327 |
| 4,664,507 | 5/1987 | Fukae et al. | 346/160 |
| 4,684,784 | 8/1987 | Tamary | 219/216 |
| 4,690,544 | 9/1987 | Forbes | 355/299 |
| 4,705,385 | 11/1987 | Palm et al. | 355/327 |
| 4,757,471 | 7/1988 | Fukae et al. | 355/212 |
| 4,956,676 | 9/1990 | Fukae et al. | 355/271 |

FOREIGN PATENT DOCUMENTS

| | | | |
|---|---|---|---|
| 3812512 | 11/1988 | Fed. Rep. of Germany . | |
| 58-95760 | 6/1983 | Japan | 355/4 |
| 59-131958 | 7/1984 | Japan . | |
| 61-223858 | 10/1986 | Japan | 355/4 |

OTHER PUBLICATIONS

European Patent Office Search Report, May 8, 1990, Application No. 88121143.7.

Patent Abstracts of Japan, vol. 8, No. 259 (p. 317) [1696] Nov. 28, 1984.

*Primary Examiner*—Joan H. Pendegrass

*Attorney, Agent, or Firm*—Jones, Askew & Lunsford

[57] ABSTRACT

A print engine including a photosensitive belt which is an endless loop vertically mounted in the copier or printer housing. A photosensitive belt stretches over a pair of rollers such that the exterior of the surface of the belt defines a developing position for an electrostatic image in a substantial vertical plane. An exposure station in the copier housing focuses light on the developing position of the photosensitive belt forming the electrostatic image. Toner applied to the electrostatic image forms a developed image which is transferred to a second endless loop belt and subsequently communicated and fixed on an image receptor, such as paper. A second endless loop belt stretches between a first roller and a second roller. The first roller is vertically spaced-apart from the second roller. Each roller is horizontally and vertically off-set from one of the pair of rollers around which the photosensitive belt is stretched. The second belt is thereby oriented at an acute angle to the photosensitve belt to have an inside surface which wraps over one of the pair of rollers to define an arcuate contact between the photosensitive belt and the second belt. The photosensitive belt and the second belt rotate in the same relative direction at the arcuate contact to effect transfer of the developed image to the second belt.

16 Claims, 2 Drawing Sheets

VERTICAL PRINT ENGINE FOR ELECTROPHOTOGRAPHIC APPARATUS

This is a continuation of U.S. Ser. No. 07/135,113, filed Dec. 18, 1987, now U.S. Pat. No. 4,901,110.

TECHNICAL FIELD

The present invention relates to print engines for electrophotographic apparatus. More particularly, the present invention relates to a vertical print engine which, installed in an electrophotographic copier or printer machine, enables the machine to have a compact footprint, a more easily accessible and shorter paper path at the top of the machine, a simpler duplex capability, less cumbersome handling of waste toner, vertically spaced development stations with horizontally disposed toner application, a direct and uniform oil flow for the fuser, and facedown delivery of prints enabling a document to be produced in its proper sequence without manual re-sorting.

BACKGROUND OF THE INVENTION

Electrophotographic methods for creating copies of documents have been incorporated into copier and printer devices for use in a wide range of applications. Machines incorporating such electrophotographic techniques have found use in offices as optical copiers of documents or document printers which receive the document image electronically.

The basic aspects of the copying process known as xerography are well known to those of skill in the art. Known electrophotographic machines use an electrostatically charged photosensitive medium or photoreceptor to receive the document image. The photoreceptor has a uniformly distributed electrostatic charge placed thereon by a conventional charging corona. A latent electrostatic image is developed on the photoreceptor by selective exposure of charged areas the photoreceptor medium to light from an image source. A variety of techniques may be used to create this latent image, including use of a stroboscopic flash and appropriate optics, a raster scanned laser, or a linear scan mechanism which moves a light source, optical elements, or both in synchronization to scan the photosensitive medium with the image of the original.

The latent image on the photoreceptor passes adjacent a source of toner materials which are pulled by an electrostatic force onto the latent image. This creates a developed image on the photoreceptor. As is knwon to those skilled in the art, these toner materials are preferably plastics which melt at a predetermined temperature and have appropriate color characteristics once they are melted.

The photoreceptor carrying the electrostatic developed image then contacts an image receptor which, in most common applications of xerography, is a sheet of paper. The toner transfers from the photoreceptor to the image receptor by electrostatic charging technique.

The image receptor now carries the toner particles and thus images the document to be copied. The image receptor passes through a heat station or fuser where the transferred toner is heated to melt the toner particles. Duration and temperature ranges to fix the image in the paper are well known by those of skill in the art.

As may be appreciated, residual toner remains on the photosensitive element after the developed image transfers to the print receptor. Such residual toner must be removed from the developing position of the photosensitive element prior to re-exposing the element to a subsequent image. Known cleaning stations include a cleaning blade which wipes residual toner from the photosensitive element into a trough. Many of these known printing machines employ an auger apparatus to convey the toner from the trough to a remote storage receptical. Such mechanisms for handling waste toner increase the complexity of the machine and require laterally remote space for storage of the waste toner. Increased handling of toner increases opportunities for toner dust contamination of other copier components.

The technique briefly described above for producing monochromatic copies may also be followed for producing color copies using a process similar to conventional three color printing. The color copier creates separate latent color component images, or color separations, on the photoreceptor by exposing the photoreceptor through appropriate color filters. Each separate color component image is developed by a toner having the appropriate color characteristics. The developed color component image is transferred to the image receptor or paper in sequence to create a composite color image. The paper carrying the composite image of three toners is passed to a fuser in a conventional manner to fix the image onto the image receptor.

As may be appreciated, the electrophotographic technique for color copies requires three separate exposures of the image on the photoreceptor to develop the latent color separated images. In color electrophotographic machines three distinct color separated images are sequentially exposed on the photoreceptor medium and developed with an appropriately colored toner material. These developed color separated images are subsequently superimposed on each other and transferred to the final print receptor, such as a sheet of paper. In the art of color electrophotography it is known to directly construct the composite color image on the final print receptor medium or, alternately, to construct the composite image on an intermediate transfer medium from which the composite color image is transferred at one time to the final print receptor. The preferred embodiment of the present invention uses an intermediate transfer medium although same is not required to practice the invention described herein.

Various improvements in the art of electrophotography permit the copier and printer machines to become smaller and more compact. One feature permitting a more compact size for such devices was replacing the cylindrical drum with a horizontally disposed flexible belt driven by longitudinally spaced rollers. Toner modules horizontally spaced adjacent the photoreceptor include hoppers for holding a supply of toner material and decorator rollers for placing the toner adjacent the charged photoreceptor. In a monochromatic copier, only one such toner module was necessary. Color copiers require at least three such toner modules, and some known copiers include a fourth module for black toner rather than using a "process black" made by combining the three color toners.

Use of a photoreceptor belt in a copier permits the copier or printer to have a compact size. The step from a rigid cylindrical drum to a flexible belt was one of the major developments in electrophotography which allowed a reduction of volume occupied by machine. Use of flexible photoreceptor belts in monochromatic electrophotographic print engines has been common for a number of years. Such compact copiers are conveniently used in offices having limited space for locating a copier. Also, such compact laser printers have a lower price and have gained acceptance as printer devices for use with microcomputers and word processing systems. However, the move toward size reduction has, heretofor, led to several drawbacks.

Until recently, practical full color electrophotographic print engines required the use of rigid cylindrical drums carrying the photoreceptor and critically machined mechanical parts in order to maintain registration in the composite developed color images as the individual separated images are placed over each other. There are relatively early patent disclosures of full color electrophotographic print engines employing photoreceptor belts, for example U.S. Pat. No. 3,999,987. However such machines did not indicate practical schemes for synchronizing movement of the photoreceptor belt and the final print receptor in a manner which assures adequate registration of the separated color component images.

Even in the early disclosures of full color electrophotographic print engines employing belts, the toner modules used for developing the latent electrostatic images were disposed beneath the photoreceptor belt. The decorator brushes contacting the photoreceptor belt were pointed in a generally upward direction. This is because there was no known practical downwardly pointing toner development module available.

A substantial step forward in reducing the size of full color electrophotographic print engines was made in the machine disclosed in U.S. Pat. No. 4,652,115 to Palm et. al. This machine architecture discloses a practical downwardly pointing toner development module in a full color electrophotographic print engine employing a belt mounted photoreceptor surface and an intermediate transfer medium, also mounted on a flexible belt. A practical control scheme for achieving a registration of sufficient accuracy to provide non-smeared full color copies using process colors is shown in U.S. Pat. No. 4,652,115.

It will therefore be appreciated that earlier machine architectures employing cylindrical drums took up a significant amount of space due to the large size of the drum. In such machines the toner development modules were generally disposed around the lower portion of the machine in order to have a significant upward component to the direction in which the decorator brushes pointed, for the reasons noted here and above. Transfer of the developed image from the photosensitive element to the ultimate print receptor was normally laterally disposed in such machines thus increasing the width of the print engine.

The use of photoreceptors mounted on flexible belts was a major step in size reduction of such machines. The conventional architecture for these machines located the expose station above the belt but the toner modules were disposed below the belt for the reasons noted above. In such machines, the paper path was located below the volume occupied by the toner development modules thus requiring descending vertical layers of expose station, photoreceptor belt, development modules, and paper path. However, clearing paper jams from the machine generally requires the user move and then replace such components adjacent the paper path. This exposes the user to heated elements and toner in the copier. Improper repositioning of the components prevents the machine from operating and leads to user frustration.

In the full color architecture disclosed in U.S. Pat. No. 4,652,115, the toner development modules are located above the upper surface of the photoreceptor belt thus reducing the height of the overall architecture by allowing both the exposure station and the development modules to be positioned above the photoreceptor. This allows the paper path to be located in close proximity to the underside of the photoreceptor belt.

However, in order to maintain the small volume of such machines, it is necessary that the printed output from same (whether copying machines or laser printers) be deposited face up in the output tray. If it is desired to modify the conventional construction of a compact office copier to produce face down copies, additional height must be added to the machine for a wraparound paper path to invert the copies provided to the machine's output tray. This has been adopted in the past, but requires the space for a complete loop around paper path to deposit the copies face down, and such a longer paper path increases the opportunity for paper jams. Also, machines printing face up with a downward directed oil fuser require complicated components to provide uniform application of oil without dribbles or spots of oil on the copy paper.

It is known to those skilled in the art that it is highly desirable to provide a compact electrophotographic printing machine which will produce face down copies so that copies being printed from a conventional computer file or copies in their natural order from an original document will be in their proper collated sequence when the printing job is finished.

Therefore there is a need in the art to provide an architecture for an electrophotographic print engine which, while handling conventional office standard types and sizes of paper, will address the deficiences of compact and full size copiers or printers. Such machines will occupy a smaller volume than heretofor possible in electrophotographic print engines, provide more direct and convenient user access to the paper path and collect waste toner in gravity fed containers. Horizontal application of toner to the vertically disposed developing position permits simpler toner modules, and the oil fuser for face down printing is less complicated.

SUMMARY OF THE PRESENT INVENTION

The present invention provides compact copiers and laser printers some of the features and advantages previously found only in large full size copiers and provides features heretofor sought but not available for compact copiers and printers. In particular, the present invention creates documents in a compact machine and places each created document face down in an output tray. Placing the documents face down keeps the copies in the proper sequence and thus eliminates the manual re-sorting which is necessary with known compact electrophotographic print devices which place the printed copy in a face up position.

In a broad aspect, the present invention provides a vertically disposed print engine to develop a latent image and then to transfer the developed image to an image receptor which, broadly speaking, intersects with the print engine at its upper end. The vertical print engine enables the machine housing to have a compact footprint, and user access to the paper path in the upper portion of the machine is more direct and convenient. Further, the vertical architecture allows use of a less complicated oil fuser for a color printer and enables the decorator rollers of the toner modules to be horizontally disposed with respect to the photosensitive element of the print engine. The present invention eliminates certain waste toner handling components used in machines of other architecture and provides modular gravity-fed cleaning stations for recovery and storage of residual waste toner.

More particularly, the print engine of the present invention includes a photosensitive flexible belt which is vertically mounted in the copier or printer housing. The flexible belt stretches over a set of upper and lower rollers such that the belt's longitudinal axis is in a vertical plane. The lower rollers preferably include a tensioning mechanism of a type well known in the art. The upper roller preferably connects to a direct current motor which drives the belt by turning the rollers.

Adjacent the lower end of the photosensitive belt on a first side of the copier is an exposure station. Conventional laser imaging apparatus is installed to mark a latent image on the photoreceptor belt. As previously explained, the photoreceptor belt is charged with a uniform electrostatic field of known voltage and polarity. Activating the imaging light source on and off traces the image in the electrostatic field of the photoreceptor belt.

The development toner modules for the present invention are vertically spaced adjacent a second longitudinal side of the print engine. A preferred embodiment of the present invention for a color copier or printer includes three toner modules for each of the three primary colors to develop the three color separations plus a fourth toner module for black. As explained previously, a separate toner module for black provides crisper more accurate monochromatic copies than using process black created by a combination of the three color toners. An even more compact embodiment of the present invention may include only one black toner module for producing monochromatic copies. This alternate embodiment is suitable for low cost monochromatic printing such as in an office environment which does not use color printing or as a microcomputer printer.

An image transfer assembly is disposed adjacent the upper end of the photoreceptor belt on the first side. The image transfer belt and the photoreceptor belt overlap or "wrap" together to communicate the developed image from the photoreceptor belt to the image transfer belt. In the monochromatic embodiment, the image transfer belt may be eliminated and the image from the photoreceptor belt transferred directly to the image receptor or paper sheet on which the copy is printed. The length of the image transfer belt is preferably an integer submultiple of the length of the photoreceptor belt. In a preferred embodiment, the photoreceptor belt is 32 inches long while the image transfer belt is 16 inches long.

The travel path for the image receptor, or paper sheets, on which the image is printed extends from the first side to the second side of the copier and intersects the image transfer belt at the top of the printer. The paper path may be considered roughly horizontal in that the paper moves from a paper supply tray on one side of the copier to a output tray on the opposite side of the copier. Thus, the vertically disposed print engine and the roughly horizontal paper path define a T-shaped configuration for the print engine. The vertical print engine permits the machine to have a narrower more compact footprint than machines with horizontal or drum print engines and enables a short paper path from the supply tray to the output tray. The paper path at the top of the printer is easily accessible through hinged doors for clearing paper jams.

A paper picker assembly using conventional cam rollers engages the top of the paper supply tray to kick a sheet of paper from the supply tray into the paper path. The paper is directed to drive rollers which push the paper into contact from above with the image transfer belt. The developed image is on the upper surface of the image transfer belt and the paper thus is placed on top of the developed image. The paper and the image transfer belt pass between a rub plate and a transfer corona in an image transfer station. The toner particles defining the image are pulled upward by the corona from the transfer belt to the bottom surface of the paper. The image defined by the toner particles is thus placed on the downward facing side of the paper. A discharge corona adjacent the transfer corona applies a charge to the sheet of paper to help separate the paper from the transfer belt which travels endlessly in a loop adjacent the upper end of the photoreceptor belt. The paper with the transferred image is guided along the paper path to the fuser station where, using conventional apparatus, the paper and toner image are heated. The toner particles melt and the image is fixed into the paper. The fixed copy is delivered facedown to an output tray on the second side of the copier. Residual toner is wiped from both the photoreceptor belt and the transfer belt by blades extending from the vertically mounted waste recepticals. The toner falls downwardly from the belt into the receptical for storage and modular disposal.

Thus the present invention overcomes the problems present in many known compact copiers or printers including desk top copiers. With such machines which output their copies face up, the reproduced copies must be manually resequenced. Because copiers incorporating the present invention output reproduced work in a face down sequence, multi-page works are reproduced in sequence and the manual re-sequencing activity is eliminated. Also, compact copiers incorporating the present invention have a more compact footprint and provide a readily accessible paper travel path. Gravity assisted cleaning stations eliminate auger transport of residual toner and modular waste containers and cleaning blades permit easy replacement of cleaning stations and disposal of the waste toner. Components such as the oil fuser and the toner module are less complicated in the print engine of the present invention. Duplex printing is facilitated by the open architecture at the top of the machine.

BRIEF DESCRIPTION OF THE DRAWINGS

Objects and advantages of the present invention will become further apparent upon reading the following detailed description and upon reference to the following drawings, in which like elements have like identifiers.

DESCRIPTION OF THE PREFERRED EMBODIMENTS

The present invention provides a vertically disposed print engine which communicates a developed electrostatic image with an intersecting substantially horizontal paper path. The photoreceptor belt of the print engine receives the latent image and the toner to develop the latent image. The developed image then transfers to an image receptor or paper sheet into which the image is fixed at a heated fuser station. A copier or printer incorporating the vertical print engine according to the present invention has a compact footprint, enables horizontally disposed decorator rollers to develop the latent image, and discharges its produced copies face down from an easily accessible paper path. Residual toner collects from the photoreceptor belt into gravity-fed disposal containers.

The present invention is readily adaptable to copying machines employing digital scanners and laser printers. The preferred embodiment disclosed herein is shown in the environment of the laser printer. However, it will be readily apparent to those skilled in the art that the present invention is usable in digital scanning copying machines and may even be applied to machines employing conventional analog optical scanners.

Figure 1:
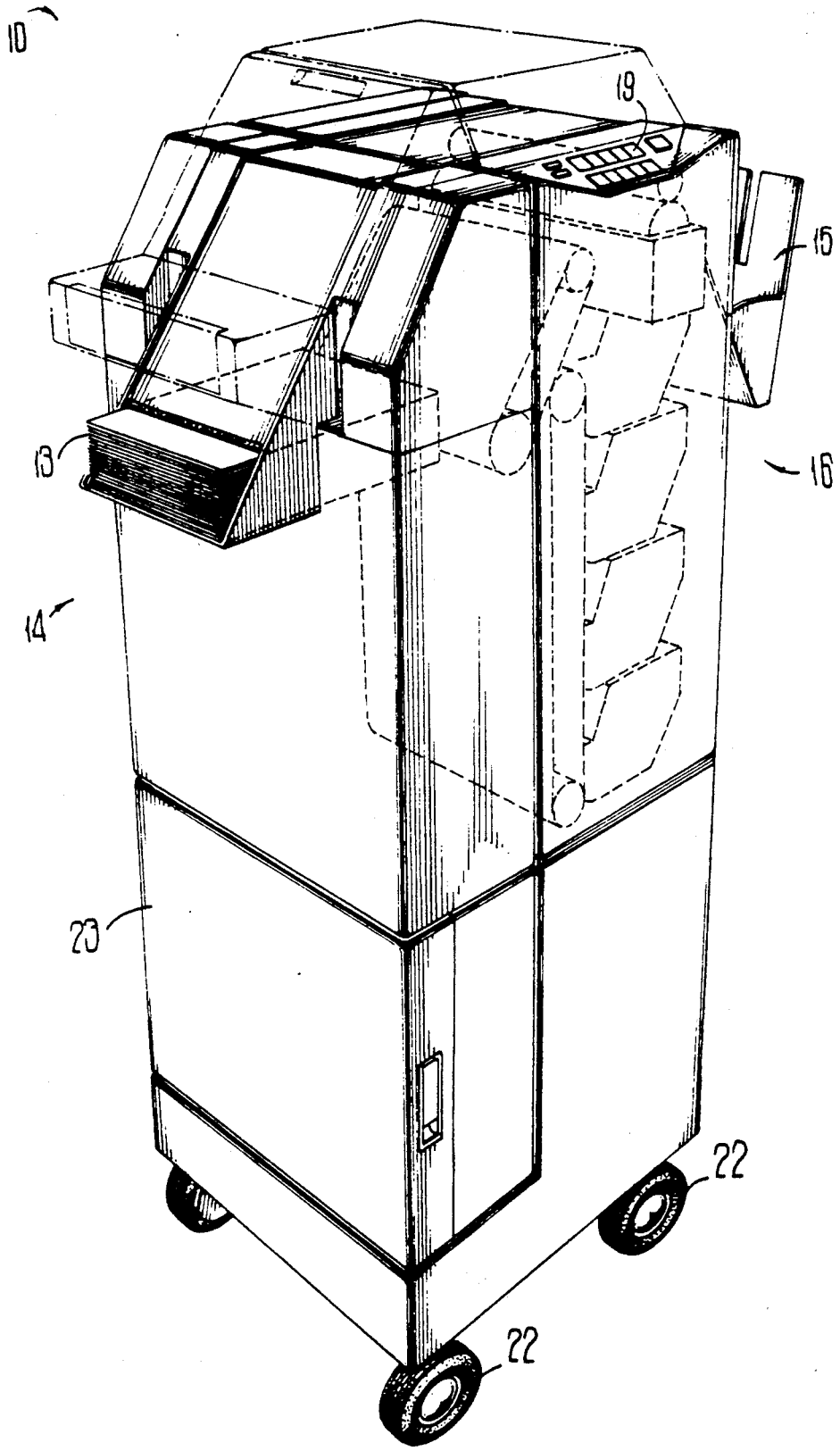
FIG. 1 is a perspective view of an electrophotographic copier having a vertically disposed print engine of the present invention illustrated in phantom.

FIG. 1 illustrates in perspective view an embodiment of a compact printer 10 which includes in hidden lines a vertical print engine 12 of the present invention. The printer 10 includes a paper supply tray 13 on a first side 14 of the printer 110, an output tray 15 on a second side 16 of the printer 10 and a control panel 19. The illustrated embodiment also includes an optional set of casters 22 on which the printer 10 may be readily rolled from one place to another. Various hinged panels on the printer 10, such as the side panel 23, provide access to the print engine 12.

Figure 2:
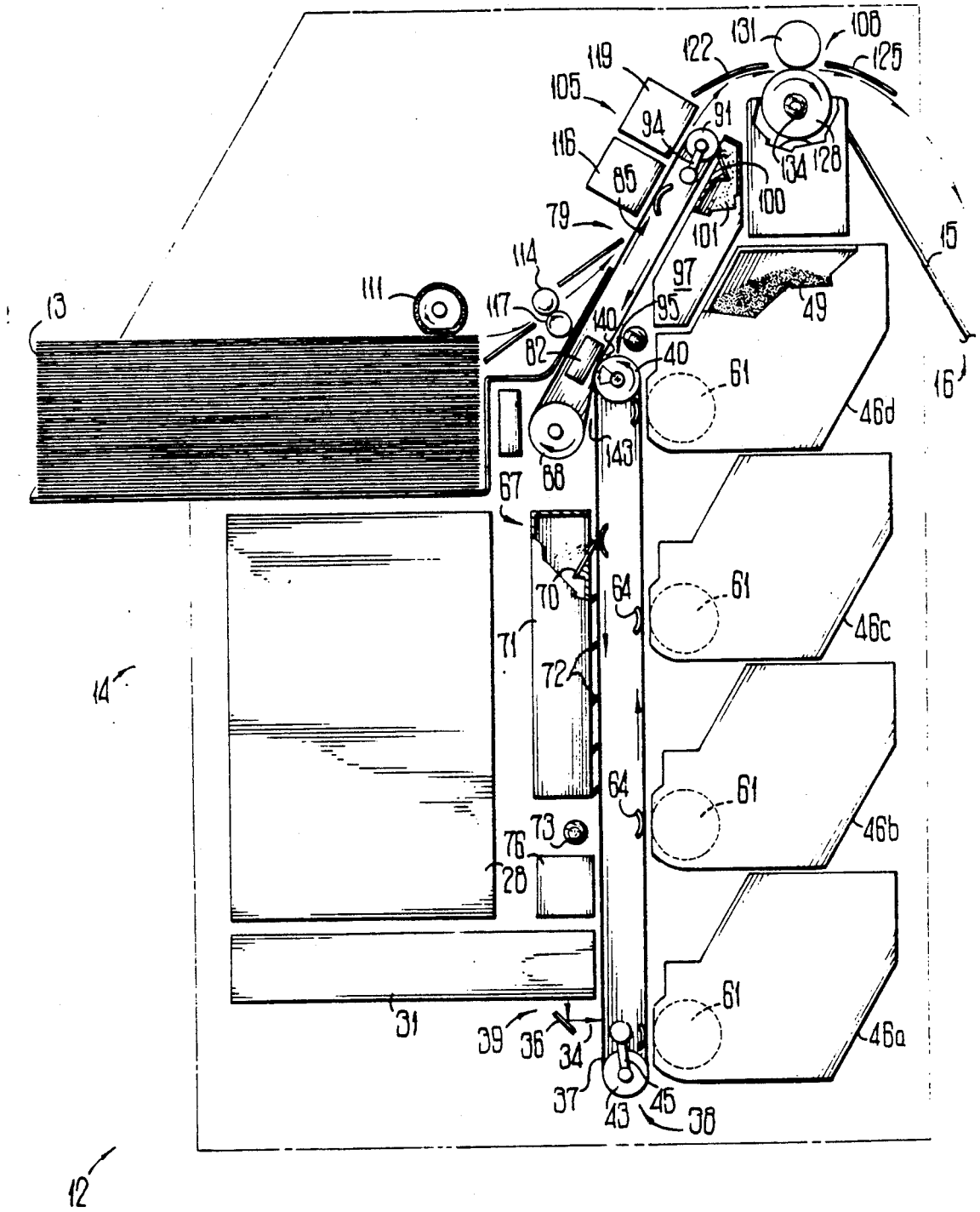
FIG. 2 is a side view detail illustration of the vertical print engine of the present invention.

Turning now to FIG. 2, there is illustrated in side view the vertically disposed print engine 12 of the present invention. The print engine 12 includes a card cage 28 which supports the electronic circuit boards for controlling the operation of the printer 10. A photoreceptor belt 37 is vertically disposed around an upper roller 40 and a lower roller 43. The rollers 40 and 43 have relatively small radii compared with the overall length of the belt 37 and are oriented such that the belt 37 is in a vertical plane. The belt 37 and the rollers 40 and 43 define the photoreceptor assembly 38. In a preferred embodiment the upper roller 40 connects to a drive motor (not illustrated.) Preferably, the drive motor operates on direct current and the motor speed is monitored and controlled by the electronic controller 28. The lower roller 43 includes a tensioning adjust arm 45 which connects to a mechanism for maintaining belt tension in a conventional manner as is known by one of skill in the art.

An image bench 31 mounts horizontally in the lower portion of the copier 10 adjacent the lower end of the photoreceptor assembly 38. The bench 31 is the light signal source of images to be copied. The light or exposure bench 31 in the preferred embodiment is a conventional raster scanning intensity modulated laser of a type normally used in electrophotographic laser print engines. The environment of the preferred embodiment disclosed herein is a conventional laser printer of the type which takes digital signals directly from a computer and creates full color output.

It will be appreciated by those skilled in the art that the environment of the preferred embodiment may be readily modified to one of a digital scanning copier wherein a conventional scanner and digitizer is connected to the print engine. It is contemplated that the preferred arrangement for such a modification would be to mount the scanner on top of the machine illustrated in FIG. 1. As is known to those skilled in the art, conventional digitizing scanners include a light source and separation filters, photosensitive elements, and appropiate analog to digital converts, for providing digital representations of three color separated images which may be subsequently applied by a raster scanned laser at exposure bench 31.

Additionally, it is possible to include a direct optical exposure bench at the location of exposure bench 31 shown in FIG. 2 wherein a wraparound paper is provided. In such an arrangement, conventional optics providing a slit exposure of the original image onto the photoreceptor belt 37 as it moves past exposure station 31 may be installed to produce a conventional optical copier employing the print engine of the present invention.

The illustrated embodiment shows a laser bench 31 horizontally mounted in the copier below the card cage 28. The bench 31, a mirror 36, and the lower end of the belt 37 define an expose station 39. A line 34 between the bench 31 and the belt 37 depicts the laser bench 31 emitting a beam of light 34 which deflects by the mirror 36 to focus on a developing position on the photoreceptor belt 37.

A series of development stations 46 are vertically spaced parallel to the longitudinal axis of the vertical photoreceptor belt 37 on the second side 16 of the printer 10. The embodiment of the present invention illustrated in FIG. 2 provides a separate toner module **46*a*, 46*b* and 46*c* for each of the three primary colors and a module 46*d* for black toner. Each toner module 46 includes a hopper 49 which retains the toner particles and the ferromagnetic carrier. The toner and carrier are conventional in the electrophotographic art, and dispense from the hopper 49 by a horizontally disposed decorator roller 61 illustrated in hidden line. A rub plate 64 is disposed adjacent each decorator roller 61 such that the belt 37 passes between the plate 64 and the roller 61**.

Returning again to the first side 14 of the printer 10, a photo conductor cleaning station 67 mounts between the controller 28 and the photoreceptor belt 37 above the image bench 31. The station 67 includes a cleaning blade 70 which wipes residual toner from the photoreceptor belt 37 into a vertically disposed toner waste container 71 adjacent belt 37. Angling upwardly from the station 67 towards the photoreceptor belt 37 are a plurality of vertically spaced fingers 72 or trap fins. Mounted in sequence below the cleaning station 67 is an erase head module 73 and a charging corona 76. The erase module 73 in the illustrated embodiment is a photo lamp while in another embodiment the erase module may be an electrically charged grid.

An image transfer assembly 79 mounts at the upper end of the photoreceptor assembly 38 to the printer 10 at an angle with respect to the assembly 38. The assembly 79 includes a transfer corona 82 and a flexible image transfer belt 85 guided by a motor-driven lower roller 88 and an upper roller 91. The upper roller 91 includes an adjustable tension arm 94 which connects to a conventional belt-tensioning mechanism known in the art. The intermediate belt 85 communicates with the photoreceptor belt 37 at the upper end of the assembly 38 by overlapping or wraping a portion of the belt 85 with the belt 37 at a first image transfer station 95.

The image transfer assembly 79 also includes at its upper end a transfer belt cleaning station 97 with a retractable cleaning blade 100 and residual toner receptacle 101.

The upper end of the printer 10 contains a paper path assembly. The paper path assembly includes the image receptor supply tray 13 (typically for paper) on the first side 14 of the print engine, a second image transfer station 105, a fuser assembly 108, and the output tray 15 on the second side 16 of the print engine. The paper path assembly in machines incorporating the vertical architecture of the present invention has a relatively short paper path because the machine may be constructed with a narrower width than prior horizontal or drum architecture machines. The narrow width contributes to a compact footprint for machines of the present invention.

The supply tray 13 includes a conventional paper picker 111 which, in cross-section, has a flat bottomed hemispherical shape. An upper drive roller 114 in the paper path assembly cooperates with a lower drive roller 117 to receive a sheet of paper driven by the picker 111 from the bin 13. Mounted in the transfer station 105 over the paper travel path at the upper end of the image transfer assembly 79 is a transfer corona 116 and a discharge corona 119. Adjacent to the transfer station 105 is the fuser assembly 108. The fuser assembly 108 includes an entry guide 122, an exit guide 125, a fuser roller 128, and a compressor roller 131. The fuser roller 128 includes an internal indirect source of heat 134. The paper path terminates in the copy output tray 15. A set of fingers (not illustrated) may be mounted in the paper path to guide the paper into the output tray 15.

In operation, the photoreceptor belt 37 defines an endless loop streched over the upper drive roller 40 and the lower tension roller 43. The belt 37 is driven by the drive roller 40 which preferably connects to a direct current motor. A uniform electrostatic field is imposed on the belt 37 by the charging corona 76 before the belt 37 moves past the adjacent expose station 39. The laser source in image bench 31 is intensity modulated and scans in a conventional raster pattern in synchronization with the movement of photoreceptor belt 37. As is known to those skilled in the art, an increase in the intensity of the laser at a given point on the photoreceptor dissipates more of the electrostatic charge at that point, thus creating a portion of the photoreceptor belt to which less toner will be attracted during the development process. A complete raster scan of an image area photoreceptor belt 37 is made for each separated color component image to create a latent electrostatic image corresponding to the separated color component image to be used in creating the final composite color image.

As the latent electrostatic mage on the development position on the belt 37 moves vertically past the toner mudules 46, the appropriate toner module 46 is activated to deposit toner materials horizontally from the hoper 49 via the roller 61 in a conventional manner onto the charged image portions of the surface of the belt 37. This creates a developed image on the belt 37. The belt 37 continues to rotate, and the leading edge of the developed image eventually reaches the point 140 in the image transfer station 95 where the photoreceptor belt 37 first makes contact with the intermediate transfer belt 85. An electrostatic field is created by the transfer corona 82, and the developed image, is transferred from the belt 37 to the belt 85 as the belts continue to rotate in contact. The toner pellets defining the developed image thus pass from the belt 37 to the beld 85 as the belts rotate the image from point 140 to point 143. In a preferred embodiment, the arc defined by the initial contact point 140 and the final contact point 143 centered at the longitudinal axis of the drive roller 40 is preferably about 40 degrees, and may range from about 38 to about 42 degrees.

It is contemplated that two mechanisms in the wrap area of the belts aid in the transfer of the image from the belt 37 to the belt 85. First, considerable mechanical force is provided in the wrap area simply from the force of having the belt 37 urged strongly into the intermediate belt 85 as shown. Second, the belt 37 is charged to a high positive potential by the charging corona 76. This surface charge causes the toner material on the belt 37 to move to the belt 85 and thus transfer the developed image. This transfer process creates an extremely strong electrostatic force between the belts 37 and 85.

As the leading edge of the developed image is approaching the wrap area at the upper end of the photoreceptor belt assembly 38, a second latent image may be formed in a development position of the photoreceptor belt 37 which is moving vertically through the expose station 39. In the event of color copying, this second image may be another color image component of the color work being printed on the apparatus of the present invention. It may be appreciated by one of skill in the art that color copying requires three revolutions of the belt 85 to fully transfer the complete color image from the photoreceptor belt 37 to the intermediate transfer belt 85. As the additional color component images are placed on the intermediate belt 85, appropriate registration mechanisms, described in further detail in U.S. Pat. No. 4,652,115 incorporated herein by reference, maintain the alignment between the photoreceptor belt 37 and the transfer belt 85. A complete monochrome image may be transferred from the photoreceptor belt 37 to the intermediate transfer belt 85 upon one revolution of the belt 85.

Some residual toner may remain on the developing portion of the belt 37 after the developing position moves out of the transfer station 95. The cleaning blade 70 wipes the residual toner from the belt 37 which falls into the toner waste container 71 at the photoconductor cleaning station 67. The plurality of fingers 72 spaced vertically below the cleaning blade 70 angularly approach but do not touch the belt 37 to trap residual toner falling adajcent the belt 37. Collecting toner in pockets defined by the fingers 72 and the container 71 reduces toner dust accumulation on the interior components of the printer 10. After the residual toner is wiped from the belt 37, the developing position on the belt passes an erase module 73 which uniformly exposes the developing position. The erased developing position of the belt 37 then passes the charging corona 76 which imposes a uniform electrostatic field on the developing position. The developing position is then ready to receive a latent image at the expose station 39.

Once a complete image is transferred to the belt 85, the printer transfers the developed image from the intermediate belt 85 to an image receptor or sheet of paper. The leading edge of the transferred developed image continues moving upward towards the transfer station 105. A cam operated paper picker is activated and, in a manner known in the art, kicks out the top sheet of paper with the leading edge of the flat bottomed hemispherical cam 111. The sheet of paper travels forward and is engaged between the rollers 114 and 117 which cooperate together to urge the paper against the transfer belt 85. The paper is held electrostatically against the developed image on the transfer belt 85, and together, the paper and belt 85 continue travelling upward along the paper path to the transfer station 105.

At the transfer station 105, the developed image on the intermediate belt 85 is transferred physically to the bottom surface of the paper. The transfer corona 116 imposes an electrostatic field around the paper and the belt 85. The toner particles are attracted by the transfer corona 116 and physically move from the belt 85 to the paper. The paper and belt 85 continue moving and pass the discharge corona 119. The corona 119 creates an electrostatic charge which helps the paper disconnect from the belt 85. The paper travels past an entry guide 122 which directs the paper into the fuser assembly 108. The paper travels between the fuser roller 128 and the compressor roller 131. The fuser roller is heated using a conventional internal indirect source of heat 134. The heat melts the plastic toner particles and the compressor roller cooperates to fix the melted toner into the paper. The exit guide 125 directs the paper downward into the copy output tray 15. A set of fingers may be mounted in the paper guide to help guide the paper into the output tray 15.

The retractable cleaning blade 100 extends and wipes residual toner from the belt 85 into the waste receptacle 101. The blade 100 then retracts. As may be appreciated, the blade 100 must retract for color copying so that the separate composite images are not destroyed before being placed on the image receptor at the transfer station 105.

Known color printing machines use an oil fuser which applies an oil to the surface of the fixing or fuser roller 128. In conventional engines printing face up, the fuser design has to address supplying sufficient oil to the surface of the fuser roller 128. Too much oil leads to oil spots on the printed document while too little oil results in toner sticking to the fuser roller 128 and the quality of the image fixed in the paper is reduced. The vertical architecture of the present invention simplifies the oil fuser components. It is contemplated that a horizontally disposed wick uniformly applies the oil from a reservoir to the fuser roller and the excess oil flows downward off the roller to the oil reservoir. Heating the lower fuser roller 128 also is contemplated to improve fusing efficiency due to the upward flow of heat to the fusing surface. It is contemplated that such an oiler structure for the fuser station in the vertical print engine of the present invention is less complicated than other known oilers.

The vertical architecture further provides a relatively short paper path in the assembly for compact copiers or printers incorporating the present invention. As shown in the illustrated embodiment in FIG. 2, the paper path is adjacent the top of the machine. Hinged covers (not illustrated, but well known to those of skill in the art) provide easy and direct access to the paper path for clearing paper jams. The present invention thus permits a user to remove jammed paper without reaching deep into the interior or unlatching major components of the machine. It is contemplated that the short paper path will prove more reliable and less susceptible to jamming than longer paper paths.

The vertical architecture of the print engine of the present invention enables the machine to have a narrower compact footprint than previous compact and full size copiers which employ the horizontal or the drum style print engine. It is contemplated that the compact vertical architecture lends towards a top-mounted loop-back duplex mechanism to intercept a printed page from the exit side of the assembly 108, convey the intercepted page to an intermediate storage tray, and subsequently pick the intercepted page for reverse side printing.

Because the photoreceptor belt 37 is disposed vertically in the print engine 12 of the present invention, the exposure bench 31, the development stations 46, and the cleaner station 67 components of the copier may be vertically spaced adjacent the photoreceptor belt 37. Specifically, the architecture permits the toner modules 46 to be spaced vertically relative to one another and positioned adjacent the belt 37. The decorator roller 61 extends from each toner module 46 horizontally to contact the electrostatically charged photoreceptor belt 37 and develop the latent image on the developing position of the photoreceptor belt 37. Such horizontal, or "three o'clock", toning permits the decorator roller 64 to sit in a shelf extending from the toner module 46. The toner particles are thus held in the toner module 46 until applied by the decorator roller 61 to the photoreceptor belt 37.

Similarly, the photoconductor cleaning station 67 mounts adjacent the photoreceptor belt 37. The cleaning blade 70 wipes residual toner from the phoroceptor belt 37 directly into a vertically disposed waste container 71 adjacent the belt 37. Vertically spaced below the cleaning blade 70 is the plurality of vertically spaced fingers 72 which trap and hold residual toner from the belt 37. The vertical architecture thus permits the cleaning of residual toner from the belt to be assisted by gravity. The removed residual toner drops directly from the blade 70 into the waste container 71. Toner dust or particles avoiding the container 71 and falling adjacent the belt 37 may be trapped by the fingers 72. In a preferred embodiment of the present invention, the waste container 71, the cleaning blade 70, and the fingers 72, are an integral modular unit permitting easy replacement and convenient disposal of the waste toner. Thus the vertical architecture of the present invention does not have to employ an auger to meter the residual toner from a collection trough to a remote storage container. These features of the gravity-assisted cleaning station 67 are also present in the cleaning station 97 for the intermediate transfer belt 85.

The priciples, preferred embodiments and modes of operation of the present invention have been described in the foregoing specification which explains that the vertical architecture overcomes the drawbacks and problems of previously known compact printers while providing features and advantages heretofor unknown, or unavailable, in compact printers. The invention is not to be construed as limited to the particular forms disclosed, because these are regarded as illustrative rather than restrictive. Moreover, variations and changes may be made by those skilled in the art without departing from the spirit of the invention as described by the following claims.

What is claimed is:

1. An electrophotographic printer machine, comprising:

means for controlling the operation of the printer machine;

a photosensitive first endless loop belt stretched across a pair of rollers such that the exterior surface of the first belt defines a developing position for an electrostatic image in a substantially vertical plane;

an exposure station configured to focus light on the developing position of the first belt for forming the electrostatic image;

means for applying toner to the electrostatic image for forming a developed image;

a second endless loop belt stretched between a first roller and a second roller;

the first roller vertically spaced-apart from the second roller and positioned on a first side of the printer horizontally and vertically off-set from one of the pair of rollers, the second roller positioned on a second side of the printer horizontally and vertically off-set from the one of the pair of rollers, the second loop belt thereby oriented at an acute angle to the first loop belt to have an outside surface which wraps over the one of the pair of rollers to define an arcuate contact between the first belt and the second belt;

means for rotating said first belt and said second belt in the same relative direction at said arcuate contact;

means for transferring the developed image from the first belt to the second belt; and means for receiving an image receptor, communicating the developed image to the image receptor and fixing the developed image to the image receptor.

2. The electrophotographic printer machine as recited in claim 1, wherein the exposure station and the toner module are positioned on different sides of the printer machine as defined by the vertical plane of the first belt.

3. The electrophotographic printer machine as recited in claim 1, further comprising three toner modules for separate toner for each of three colors.

4. The electrophotographic printer machine as recited in claim 1, further comprising four toner modules for separate toner for each of three colors and black.

5. The electrophotographic printer machine as recited in claim 1, wherein the means for transferring the developed image comprises an electrostatic corona.

6. The electrophotographic printer machine as recited in claim 1, further comprising means for cleaning residual toner from the first belt.

7. The electrophotographic printer machine as recited in claim 6, wherein the means for cleaning comprises:

a receptacle mounted adjacent the vertical plane in which the belt is disposed; and a cleaning blade extending from the receptacle to the first belt, whereby residual toner is brushed from the first belt into the receptacle after the developed image transfers to the second belt.

8. The electrophotographic printer machine as recited in claim 6, further comprising a second means for cleaning residual toner from the second belt.

9. The electrophotographic printer machine as recited in claim 8, wherein the second means for cleaning comprises:

a second receptacle; and a second cleaning blade extending from the second receptacle to the second belt, whereby residual toner is brushed from the second belt into the receptacle after the developed image transfers to the image receptor.

10. The electrophotographic printer machine as recited in claim 1, further comprising an erase station vertically spaced from the exposure station, whereby the developing position is uniformly erased in preparation of receiving the electrostatic image.

11. An electrophotographic printer machine, comprising:

means for controlling the operation of the printer machine;

a photosensitive first endless loop belt stretched across a pair of rollers such that the exterior of the surface of the first belt defines a developing position for an electrostatic image in substantially vertical plane;

an exposure station configured to focus a beam of light on the developing position of the first belt for forming the electrostatic image;

means for applying toner to the electrostatic image for forming a developed image;

a second endless loop belt stretched between a first roller and a second roller;

the first roller vertically spaced-apart from the second roller and positioned on a first side of the printer horizontally and vertically off-set from one of the pair of rollers, the second roller positioned on a second side of the printer horizontally and vertically off-set from the one of the pair of rollers, the second loop belt thereby oriented at an acute angle to the first loop belt to have an outside surface wraps over the one of the pair of rollers to define an arcuate contact between the first belt and the second belt;

means for rotating said first belt and said second belt in the same relative direction at said arcuate contact;

means for transferring the developed image from the first belt to the second belt;

means for receiving an image receptor, communicating the developed image to the image receptor and fixing the developed image to the image receptor;

means for cleaning residual toner from the first belt after the developed image transfers to the second belt and for cleaning residual toner from the second belt after the developed image is transferred to the image receptor; and an erase station positioned near the exposure station, whereby the developing position is uniformly erased in preparation of receiving the electrostatic image.

12. A multicolor electrophotographic copy machine, comprising:

means for controlling the operation of the printer machine;

a photosensitive first endless loop belt stretched across a pair of rollers such that the exterior of the surface of the first belt defines a developing position for an electrostatic image in a substantially vertical plane;

an exposure station on a first side of the printer machine as defined by the vertical plane of the first belt configured to focus light corresponding to a color separated optical image of a document on the developing position of the first belt for forming the electrostatic image;

a plurality of toner modules spaced apart vertically in path parallel to and on a second side of the plane defined by the first belt, each toner module holding a color toner different from each toner module, for developing the electrostatic image with toner applied from the corresponding color toner module;

a second endless loop belt strectched between a first roller and a second roller;

the first roller vertically spaced-apart from the second roller and positioned on the first side of the printer horizontally and vertically off-set from one of the pair of rollers, the second roller positioned on the second side of the printer horizontally and vertically off-set from the one pair of rollers, the second belt thereby oriented at an acute angle to the first belt to have an outside surface which wraps over the one of the pair of rollers to define an arcuate contact between the first belt and the second belt;

means for rotating said first belt and said second belt in the same relative direction at said arcuate contact;

means for transferring and superimposing the developed image in different colors as formed from the first belt to the second belt; and means for receiving an image receptor, communicating the superimposed developed images from the second belt to the image receptor and fixing the superimposed developed images to the image receptor.

13. The multicolor electrophotographic printer machine as recited in claim 12, further comprising an erase station vertically spaced from the exposure station, whereby the developing position is uniformly erased in preparation of receiving the electrostatic image.

14. The multicolor electrophotographic printer machine as recited in claim 12, further comprising means for cleaning residual toner from the first belt after the developed image transfers to the second belt and for cleaning residual toner from the second belt after the developed image is transferred to the image receptor.

15. The multicolor electrophotographic printer machine as recited in claim 12, further comprising three toner modules for separate toner for each of three colors.

16. The multicolor electrophotographic printer machine as recited in claim 12, further comprising four toner modules for separate toner for each of three colors and black.

* * * * *

UNITED STATES PATENT AND TRADEMARK OFFICE

CERTIFICATE OF CORRECTION

PATENT NO. : 5,027,158

DATED : June 25, 1991

INVENTOR(S) : E. Neal Tompkins, et al.

It is certified that error appears in the above-identified patent and that said Letters Patent is hereby corrected as shown below:

Column 12:

In Claim 1, line 6, after "exterior", please insert --of the--.

Column 14:

In Claim 11, line 8, after "in", please insert --a--.

In Claim 11, line 25, after "face", please insert --which--.

In Claim 12, line 16, after "in" please insert --a--.

In Claim 12, line 19, after "each", please insert --other--.

Signed and Sealed this

Fifteenth Day of December, 1992

*Attest:*

DOUGLAS B. COMER

*Attesting Officer*

*Acting Commissioner of Patents and Trademarks*